United States Patent [19]

Nisimura

[11] 3,953,942

[45] May 4, 1976

[54] APPARATUS FOR GRINDING INNER SURFACE OF A VEHICLE TIRE

[75] Inventor: Seiichiro Nisimura, Shakujii, Japan

[73] Assignee: Bridgestone Tire Company Limited, Tokyo, Japan

[22] Filed: Feb. 6, 1975

[21] Appl. No.: 547,878

[30] Foreign Application Priority Data

Feb. 15, 1974 Japan ..... 49-18772

[52] U.S. Cl. ..... 51/33 W; 51/106 R; 51/DIG. 33; 157/13

[51] Int. Cl.[2] ..... B24B 5/50

[58] Field of Search ..... 51/33 W, 47, 99, 106 R, 51/DIG. 33; 157/13

[56] References Cited

UNITED STATES PATENTS

| | | | |
|---|---|---|---|
| 3,128,579 | 4/1964 | Kehoe et al. | 51/106 R |
| 3,641,709 | 2/1972 | Gazuit | 51/99 X |
| 3,691,580 | 9/1972 | Eggert | 51/99 X |
| 3,766,688 | 10/1973 | Maytay | 51/99 X |
| 3,825,965 | 7/1974 | Root et al. | 51/DIG. 33 X |

*Primary Examiner*—Al Lawrence Smith
*Assistant Examiner*—James G. Smith
*Attorney, Agent, or Firm*—Haseltine, Lake & Waters

[57] ABSTRACT

In order to grind the inner surface of a vehicle tire together with a mold releasing agent for amending an unbalanced portion on the tire and scars on the inner surface of the tire, a grinding apparatus is operated in an automated fashion and comprises a frame structure, a supporting member mounted on the frame structure, a swing member pivotally mounted on the forward end portion of the supporting member, a grinder wheel rotatably mounted on the lower end portion of the swing member, a swing member swinging mechanism mounted on the supporting member for swinging the swing member about its own axis, a grinder wheel rotating mechanism mounted on the supporting member and the swing member for rotating the grinder wheel, a tire rotating mechanism mounted on the frame structure opposing to the grinder wheel for holding and rotating the vehicle tire at a predetermined peripheral speed, a grinder wheel moving mechanism mounted on the frame structure for relatively moving the supporting member and the tire rotating mechanism to move the grinder wheel toward or away from the inner surface of the vehicle tire on the tire rotating mechanism.

16 Claims, 9 Drawing Figures

APPARATUS FOR GRINDING INNER SURFACE OF A VEHICLE TIRE

The present invention relates to production of vehicle tires and, more particularly, to an apparatus for grinding the inner surface of a vehicle tire to remove rubberized material together with a mold releasing agent used for facilitating release of the tire from its mold.

In general, there has been a grinding operation of grinding the inner surface of the vehicle tire in order to grind or remove rubberized material with the mold releasing agent for amending an unbalanced portion of the vehicle tire and one or more scars appeared on the inner surface of the vehicle tire in the production of the vehicle tires. It is a common practice in the grinding operation to emerge fresh rubberized material by removing superficial rubberized material together with the mold agent to adhere additional rubberized material onto the unbalanced portion and the scars on the inner surface of the vehicle tire so that the vehicle tire may be circumferentially radially balanced. The grinding operation has thus far been manually operated in such a manner that an operator moves the vehicle tire to make its axis horizontally stationary and fixes at least a pair of bead opening tools on the bead portions of the tire so that the operator may grip a flexible handle secured to an axis of a grinder wheel pressed on the inner surface to be ground. There have, hence, been encountered such difficulties that the operator is required not only to insert the grinder wheel and his own hands through a gap between the bead portions of the tire into the interior thereof but to manually rotate the tire. Especially in large size tires, for example, such as truck, bus, airplane tires and the like, further difficulties have been promoted in opening or widening the bead portions of the tire for the grinding operation. The grinding operation is, thus, needed not only for heavy human labour but for much time. In addition, the operator is liable to aspirate much scattered power of the rubberized material ground by the grinder wheel which is extremely bad for health.

It is, therefore, an object of the present invention to eliminate such drawbacks inherent in the prior art and to provide an apparatus for grinding the inner surface of the vehicle tire in an automated fashion which will provide increased production efficiency and contribute to elimination of the laborious operation thus far necessitated and non-hygienic conditions thus far incurred in the grinding operation of the vehicle tires.

In accordance with the present invention, there will be provided to accomplish such an object an apparatus which comprises a frame structure, a supporting member mounted on the frame structure, a swing member pivotally mounted on the forward end portion of the supporting member, a grinder wheel rotatably mounted on the lower end portion of the swing member, a swing member swinging mechanism mounted on the supporting member for swinging the swing member about its own axis, a grinder wheel rotating mechanism mounted on the supporting member and the swing member for rotating the grinder wheel, a tire rotating mechanism mounted on the frame structure opposing to the grinder wheel for holding and rotating the vehicle tire at a predetermined peripheral speed, a grinder wheel moving mechanism mounted on the frame structure for relatively moving the supporting member and the tire rotating mechanism to move the grinder wheel toward or away from the inner surface of the vehicle tire on the rotating machanism.

The frame structure may include a stationary frame structure and a movable frame structure horizontally movably mounted on the stationary frame structure, having a pair of substantially vertically upstanding guide rods and a slider slidably coupled with the upstanding guide rods and supporting the supporting member, and the grinder wheel moving mechanism may include horizontally actuating means mounted on the stationary frame structure and coupled with the movable frame structure for horizontally moving the movable frame structure and vertically actuating means mounted on the movable frame structure and coupled with the slider for vertically moving the slider so that the grinder wheel moves toward or away from the inner surface of the vehicle tire on the tire rotating mechanism.

The horizontally actuating means may consist of a fluid-operated cylinder horizontally fixed on the stationary frame structure and having a piston rod connected to the movable frame structure for horizontally moving the movable frame structure, and the vertically actuating means may consist of a fluid-operated cylinder vertically mounted on the movable frame structure and having a piston rod connected to the slider for vertically sliding the slider along the upstanding guide rods so that the grinder wheel moves toward or away from the inner surface of the vehicle tire on the tire rotating mechanism.

The swing member swinging mechanism may consist of a fluid-operated cylinder having a piston rod pivotally connected to the upper portion of the swing member for swinging the swing member about its own pivotal axis and a rear end portion pivotally connected to a projection formed on the supporting member.

The grinder wheel rotating mechanism may include a driving motor on a base plate mounted on the slider, a first rotary shaft rotatably mounted on the supporting member and the swing member at the pivotal axis of the swing member, first internediate driving means provided between the driving motor and the first rotary shaft for transmitting the torque from the driving motor to the first rotary shaft, a second rotary shaft rotatably mounted on the lower end portion of the swing member supporting the grinder wheel and second intermediate driving means provided between the first rotary shaft and the second rotary shaft for transmitting the torque from the first rotary shaft and the second rotary shaft.

The tire rotating mechanism may include a pair of first hand-drum shaped rollers rotatably mounted on the stationary frame structure opposing to the movable frame structure and spaced from each other, each roller having a rotary shaft disposed in parallel with the supporting member, a second hand-drum shaped roller having an axis in parallel with the first hand-drum shaped rollers, mounted on the stationary frame structure to be disposed between and above the first hand-drum shaped rollers and movable toward or away from the first hand-drum shaped rollers for holding the vehicle tire in cooperation with the first hand-drum shaped rollers, a driving motor connected to one of the rotary shaft and intermediate driving means drivably connecting the rotary shafts for transmitting the torque from the one of the rotary shaft to the other remaining rotary shaft so that the vehicle tire is held by the first and second hand-drum shaped rollers and rotated by the first hand-drum shaped rollers.

The features and advantages of the present invention will become more apparent from the following description taken in conjunction with the accompanying drawings, in which.

Figure 1:
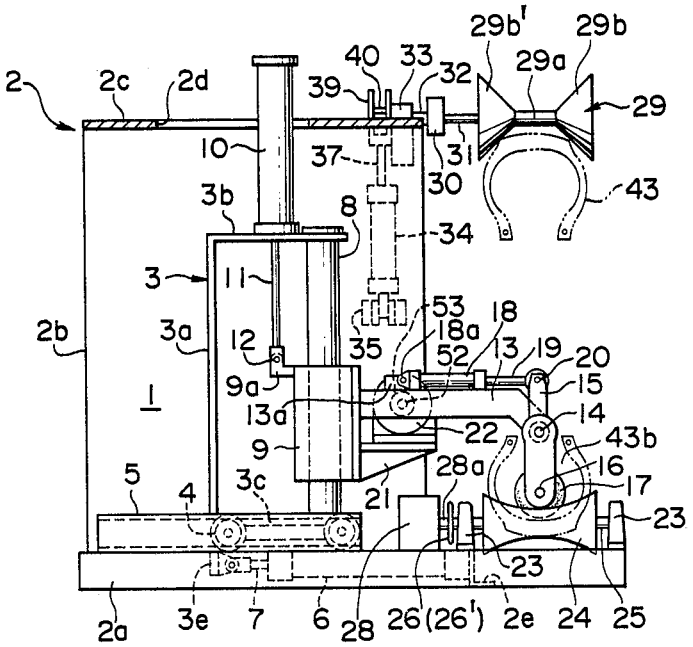
FIG. 1 is a side elevational view, partly in section, of a preferred embodiment of the apparatus according to the present invention.
Figure 2:
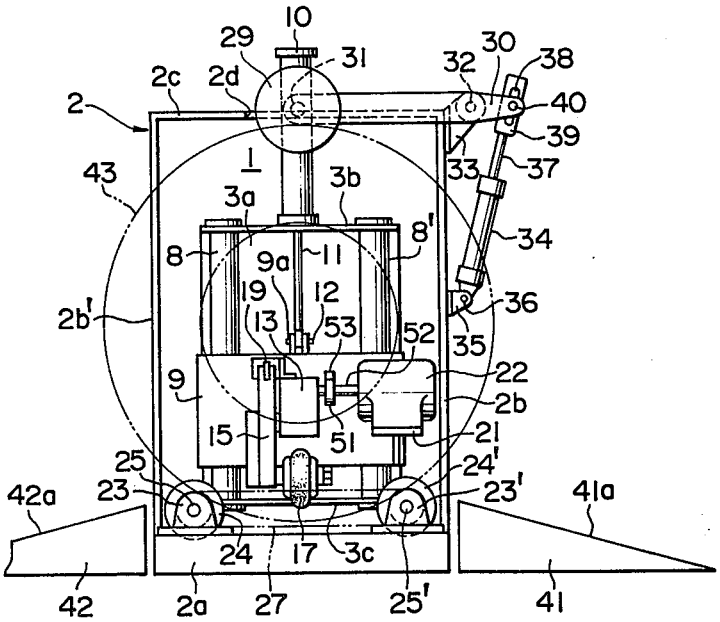
FIG. 2 is a front view showing the embodiment of the apparatus in FIG. 1.

Reference will now be made to FIGS. 1 to 4, especially to FIGS. 1 and 2. The apparatus embodying the present invention is shown comprising a frame structure 1 which includes a stationary frame structure 2 and a movable frame structure 3 horizontally movably mounted on the stationary frame structure 2. The stationary frame structure 2 includes a stationary base frame structure 2*a*, a pair of vertically upstanding side plate members 2*b* and 2*b*′ opposingly mounted on the base frame structure 2*a* to be disposed in parallel with each other and spaced from each other at a predetermined distance and a horizontal plate member 2*c* having both ends rigidly connected to both the upper ends of the side plate members 2*b* and 2*b*′. The horizontal plate member 2*c* has in its central portion an aperture 2*d* extending in the same direction as the moving direction of the movable frame structure 3 and permitting a fluid-operated cylinder, which will be hereinafter described, to vertically extend therethrough and be horizontally movable in unison with the movable frame structure 3. The movable frame structure 3 is provided between the side plate members 2*b* and 2*b*′ on the stationary base frame structure 2*a* and movable in parallel with the side plate members 2*b* and 2*b*′. The movable frame structure 3 includes an upstanding plate member 3*a*, a horizontally forwardly extending upper plate member 3*b* having a rear end rigidly connected to the upper end of the upstanding plate member 3*a* and horizontally forwardly extending lower plate member 3*c* having a rear end rigidly connected to the lower end of the upstanding plate member 3*a*. The lower plate member 3*c* of the movable frame structure 3 carries at both sides thereof two pairs of rotatable wheels 4 which are held in rotatable engagement with a pair of spaced parallel guide rails fixedly mounted on the base frame structure 2*a* of the stationary frame structure 2, only one of which is illustrated in FIG. 1 as indicated at 5. A fluid-operated cylinder 6 has a piston rod 7 the top end of which is pivotally connected to a bracket 3*e* rigidly mounted on the lower surface of the lower plate member 3*c* of the movable frame structure 3 and a rear end rigidly connected to a bracket 2*e* fixedly mounted on the stationary base frame structure 2*a* of the stationary frame structure 2. As the fluid-operated cylinder 6 is thus actuated to cause the piston rod 7 to be projected or retracted, the movable frame structure 3 is caused to horizontally move backwardly and forwardly and the wheels 4 are caused to rotate in the guide rails 5. A pair of upstanding guide rods 8 and 8′ are spaced from each other at a predetermined distance, each having one end which is rigidly connected to the upper plate member 3*b* of the movable frame structure 3 and the remaining end which is rigidly connected to the lower plate member 3*c* of the movable frame structure 3. A slider 9 is vertically slidably coupled with the guide rods 8 and 8′. A fluid-operated cylinder 10 is vertically mounted on the upper plate member 3*b* of the movable frame structure 3 and projected through the aperture 2*d* formed in the horizontal plate member 2*c* of the stationary frame structure 2, having a piston rod 11 the bottom end portion of which is pivotally connected as at 12 to a protrusion 9*a* projected from the rear upper surface of the slider 9. As the fluid-operated cylinder 10 is thus actuated to cause the piston rod 11 to be projected or retracted, the slider 9 is caused to move downwardly or upwardly along the guide rods 8 and 8′.

It is now to be noted that although vertical movement of the slider 9 is effected by the fluid-operated cylinder 10 in the above-mentioned embodiment, the vertical movement of the slider 9 may be performed instead of the fluid-operated cylinder 10, by means of other devices, for example, one of which may comprise a driving screw threaded through the slider 9 between the guide rods 8 and 8′ and having the upper and lower ends rotatably connected to the upper and lower plate members 3*b* and 3*c*, respectively, of the movable frame structure 3 and a driving motor mounted on the upper plate member 3*b* of the movable frame structure 3 in rotatably driving engagement with the driving screw so as to vertically slide the slider 9.

A horizontal supporting member 13 is fixedly mounted at its rear end on the front surface of the slider 9 and has a front end portion pivotally supporting an intermediate portion of a swing member 15 by means of a rotary shaft 14. A fluid-operated cylinder 18 has a piston rod 19 pivotally connected as at 20 to the upper end portion of the swing member 15 and a rear end portion pivotally connected as at 18*a* to a projection 13*a* formed on the supporting member 13. As the fluid-operated cylinder 18 is thus actuated to cause the piston rod 19 to be projected forwardly or retracted backwardly, the swing member 15 is caused to swing about the rotary shaft 14 so that the lower end of the swing member 15 is caused to move backwardly or forwardly. A grinder wheel 17 is rotatably mounted on the lower end portion of the swing member 15 by way of a rotary shaft 16 and driven by an electric motor 22 mounted on a base plate member 21 which is rigidly attached to the front surface of the slider 9 in the vicinity of the rear end of the supporting member 13. The driving connection between the electric motor 22 and the grinder wheel 17 will be described in detail hereinafter in FIGS. 3 and 4. A pair of lower hand-drum shaped rollers 24 and 24', each having a gradually small diameter toward its central portion, carry respective rotary shafts 25 and 25' which are disposed in parallel to the guide rails 5 and are rotatably supported by respective bearings 23 and 23' opposingly mounted on the front portion of the stationary base frame structure 2*a*. A pair of sprocket wheels 26 and 26', one of which is only illustrated in FIG. 1, are fixedly mounted on the rear end portions of the respective rotary shafts 25 and 25' and a chain 27 is streched over the sprocket wheels 26 and 26'. The rotary shaft 25 is rigidly connected to a rotary shaft 28*a* of a reversibly rotatable electric motor 28 with a reduction gear unit so that when the electric motor 28 is energized to rotate, the rotary shaft 28*a* is caused to rotate and the hand-drum shaped rollers 24 and 24' are, as a consequence, caused to rotate by way of the rotary shafts 25 and 25' of the hand-drum shaped rollers 24 and 24', the sprocket wheels 26 and 26' and the chain 27. The rotary shaft 28*a* of the electric motor 28 may, of course, be rigidly connected to the rotary shaft 25' of the hand-drum shaped roller 24' in stead of being connected to the rotary shaft 25 of the hand-drum shaped roller 24. An upper hand-drum shaped roller 29 is disposed between and above the lower hand-drum shaped rollers 24 and 24' and has a rotary shaft 31 freely rotatably mounted on the free end portion of a swing lever 30 and in parallel with the rotary shafts 25 and 25' of the lower hand-drum shaped rollers 24 and 24'. The upper hand-drum shaped roller 29 comprises a cylindrical portion 29*a* and a pair of conical portions 29*b* and 29*b'* opposing to each other and rigidly connected to both the ends of the cylindrical portion 29*a*. The swing lever 30 is pivotally supported at its intermediate portion through a pivotal pin 32 by a bracket 33 fixedly secured to the upper portion of the side plate member 2*b* of the stationary frame structure 2. A fluid-operated cylinder 34 is rotatably supported as at 36 by a bracket 35 fixedly secured to the side plate member 2*b* of the stationary frame structure 2 and has a piston rod 37 to the top end of which is connected a guide member 39 with a slot 38 extending in an axial direction of the piston rod 37 of the fluid-operated cylinder 34. A pin 40 is rigidly supported by the other remaining free end of the swing lever 30 and adapted to be projected through the slot 38 of the guide member 39. As the fluid-operated cylinder 34 is thus actuated to cause the piston rod 37 to be projected or retracted, the swing lever 30 is caused to swing about the pivotal pin 32 through the guide member 39 and the pin 40 so that the upper hand-drum shaped roller 29 is moved toward or away from the lower hand-drum shaped rollers 24 and 24' so as to hold a vehicle tire 43 in cooperation with the lower hand-drum shaped rollers 24 and 24' as shown in phantom lines in FIGS. 1 and 2. A pair of guide base members 41 and 42 are disposed in close contact with both the sides of the stationary base frame structure 2 for guiding vehicle tires. The guide base member 41 has an inclined upper surface 41*a* connecting the upper peripheral surface of the lower hand-drum shaped roller 24' and a floor so as to easily roll the vehicle tires from the floor to the lower hand-drum shaped roller 24'. The guide base member 42 also has an inclined upper surface 42*a* connecting the upper peripheral surface of the lower hand-drum shaped roller 24 and the floor so as to easily roll the vehicle tires from the lower hand-drum shaped roller 24 to the floor.

Figure 3:
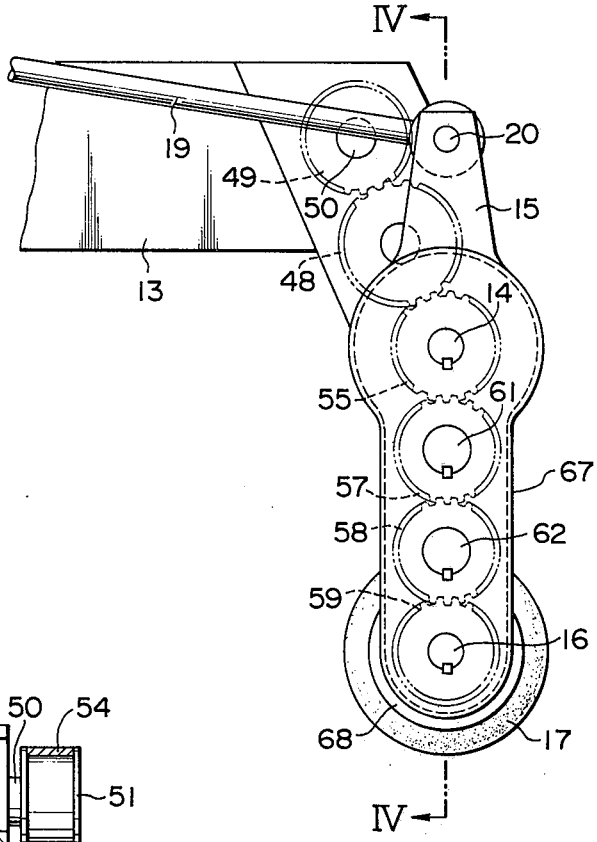
FIG. 3 is a side elevational view, on a large scale, showing the swing member, the grinder wheel and the top end portion of the supporting member incorporated into the embodiment of FIG. 1.
Figure 4:
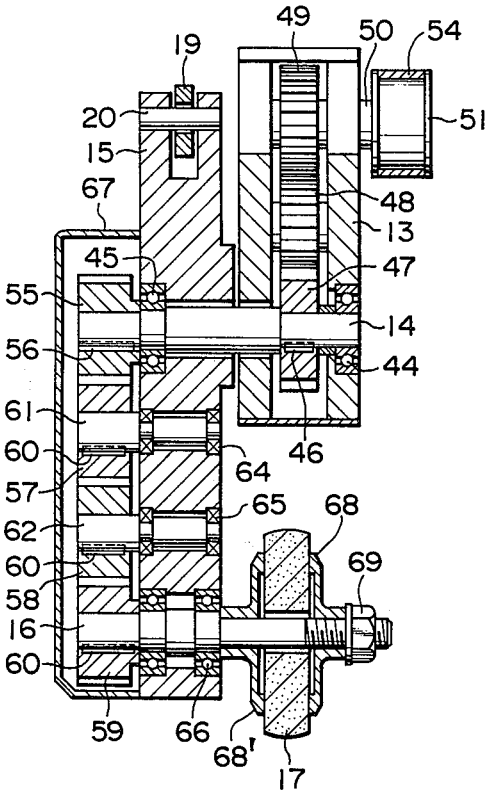
FIG. 4 is a cross sectional view, on a large scale, taken along line IV—IV of FIG. 3.

Referring to FIGS. 3 and 4 of the drawings, bearings 44 and 45 are encased in the front end portion of the horizontal supporting member 13 and in the intermediate portion of the swing member 15, respectively, to retain the rotary shaft 14, one free end portion of which is adapted to rigidly mount a gear 47 by means of a key 46. The gear 47 is meshed with a gear 48 which is, in turn, in meshing engagement with a gear 49. The gears 47, 48 and 49 are accommodated in the hollow chamber formed in the front end portion of the supporting member 13. A rotary shaft 50 of the gear 49 has one free end portion projecting outwardly of the supporting member 13 and rigidly mounted pulley 51 thereon. The pulley 51 is driven by the electric motor 22 through an endless loop belt 54 streched over the pulley 51 and a pulley 53 fixedly mounted on a rotary shaft 52 of the electric motor 22 shown in FIGS. 1 and 2. On the other remaining free end portion of the rotary shaft 14 is fixedly mounted a gear 55 by means of a key 56. The gear 55 is meshed with a gear 57 which is, in turn, in meshing engagement with a gear 58 meshed with a gear 59. The gears 57, 58 and 59 are fixedly mounted on rotary shafts 61, 62 and 16, respectively, by means of their respective keys 60, and the rotary shafts 61, 62 and 16 are rotatably retained by their respective bearings 64, 65 and 66 encased in the lower end portion of the swing member 15. The covering member 67 is mounted on the swing member 15 for covering the gears 55, 57, 58 and 59. The rotary shaft 16 mounting the gear 59 has one free end portion projecting through the swing member 15 opposite to the covering member 67 and supporting the grinder wheel 17 thereon. Both sides of the grinder wheel 17, on the rotary shaft 16, are provided with a pair of annular clamping metals 68 and 68' which are fixedly mounted on the rotary shaft 16 for clamping the grinder wheel 17 to the rotary shaft 16 by threading screw nut 69 onto the rotary shaft 16.

The operation to grind, for example, an unbalanced portion of the vehicle tire in the apparatus thus constructed and arranged will now be described with reference to FIGS. 1 and 2.

When the apparatus embodying the present invention is held at rest, the fluid-operated cylinder 6 is maintained in a condition having its piston rod 7 kept backwardly projected so that the movable frame structure 2 is held in a position remotest from the upper and lower hand-drum shaped rollers 29, 24 and 24'. Under these conditions, the fluid-operated cylinder 10 on the horizontal plate member 3*b* of the movable frame structure 3 is in a condition having its piston rod 11 retracted so that the slider 9 is at the uppermost end of the guide rods 8 and 8'. The supporting member 13 is consequently held in an uppermost lifted position so that the swing member 15 and the grinder wheel 17 are held in respective uppermost positions. On the other hand, the fluid-operated cylinder 34 on the side plate member 2*b* of the stationary frame structure 2 is in a condition having its piston rod 37 retracted so that the swing lever 30 is swung in a clockwise direction about the pivotal pin 32 by way of the guide member 39 and the pin 40. The upper hand-drum shaped roller 29 supported by the swing lever 30 is consequently held in an uppermost lifted position.

Figure 7:
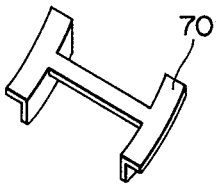
FIG. 7 is a perspective view, on a large scale, showing a bead opening tool to be attached to the bead portions of the vehicle tire during the grinding operation of the embodiment of the present invention.
Figure 8:
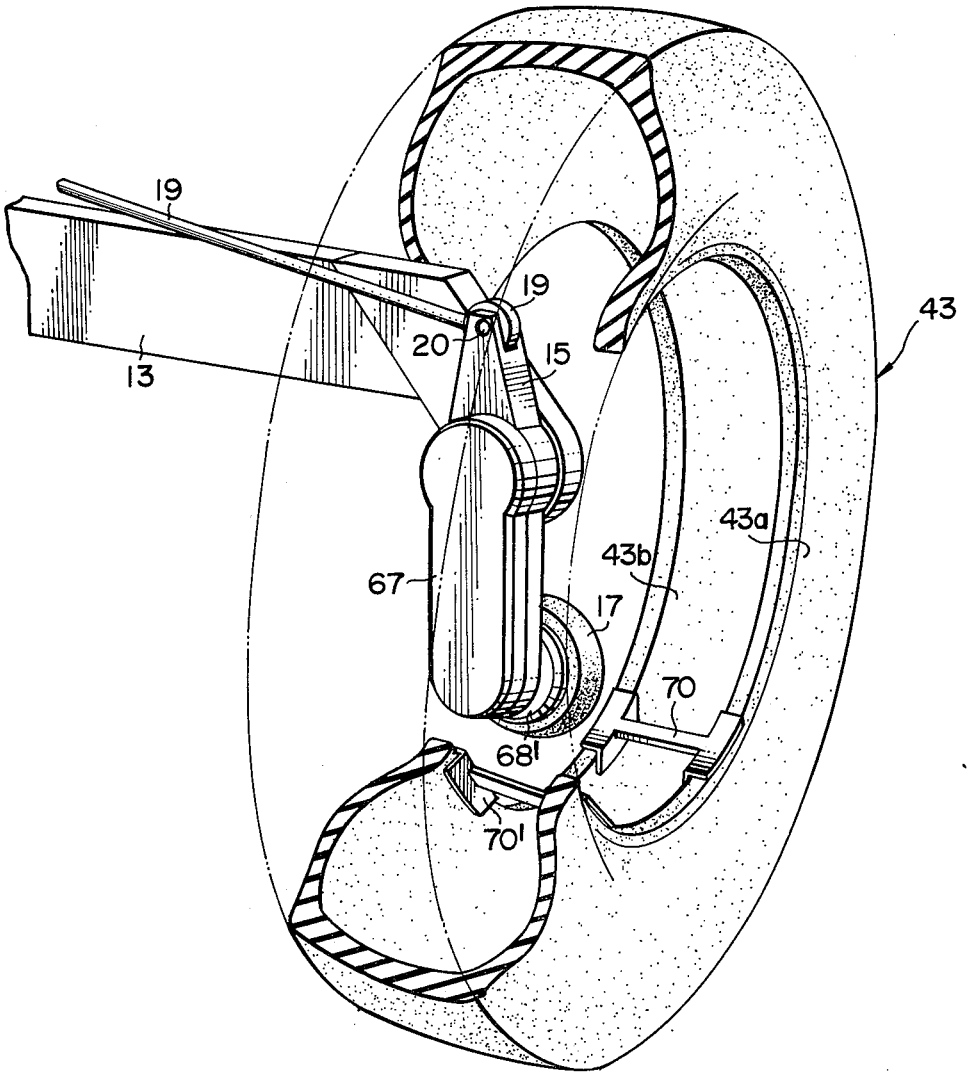
FIG. 8 is a perspective view showing the vehicle tire having a pair of bead opening tools attached to the bead portions thereof.

Before starting the apparatus thus conditioned, a preliminary prepared unbalanced tire 43 is manually or automatically rolled over the guide base member 41 to the lower hand-drum shaped rollers 24 and 24' and rested on the rollers 24 and 24'. The unbalanced tire 43 is rotated so as to have its unbalanced portion retained in a downmost rest position and thereafter a pair of bead opening tools 70 and 70' shown in FIGS. 7 and 8 are attached to bead portions 43*a* of the tire 43 so that the tools 70 and 70' may be positioned at both the sides of the unbalanced portion of the tire 43. The fluid-operated cylinder 34 on the side plate member 2*b* of the stationary frame structure 2 is then actuated to cause the piston rod 37 to be projected upwardly. The swing lever 30 is consequently swung in a counter-clockwise direction about the pivotal pin 32 as shown in FIG. 2 so that the upper hand-drum shaped roller 29 is downwardly moved to be held in contact with the peripheral surface of the unbalanced tire 43. The fluid-operated cylinder 6 is then actuated to cause the piston rod 7 to be retracted. The movable frame structure 3 is consequently moved frontwardly to cause the supporting member 13 to be moved toward the tire 43 so that the grinder wheel 17 is positioned within a gap between the bead portions of the tire 43. The fluid-operated cylinder 10 is then actuated to cause the piston rod 11 to be projected downwardly so that the grinder wheel 17 is held in pressing contact with the inner surface of the unbalanced portion of the tire 43. The electric motors 22 and 28 are concurrently energized to be rotated. The pulley 53 on the rotary shaft 52 of the electric motor 22 is consequently caused to be rotated, and the endless loop belt 54 on the pulley 53 is driven to cause the grinder wheel 17 on the rotary shaft 16 rotated by way of the pulley 51 on the rotary shaft 50 and the gears 49, 48, 47, 55, 57, 58 and 59 in FIGS. 3 and 4. On the other hand, the lower hand-drum shaped roller 24 is consequently caused to be rotated and also the other lower hand-drum shaped roller 24' is caused to be rotated through the chain 27 on the sprocket wheels 26 and 26' so that the tire 43 is rotated at a relatively slow peripheral speed with the action of the reduction gear unit involved in the electric motor 28. In this instance, the upper hand-drum shaped roller 29 is freely rotated in a condition being in a frictional contact with the tire 43. Also in this instance, when the fluid-operated cylinder 18 is actuated to cause its piston rod 19 projected forwardly and retracted backwardly, the swing member 15 is reciprocally swung about the rotary shaft 14 to cause the grinder wheel 17 to be moved forwardly and backwardly. The inner surface of the unbalanced portion of the tire 43 is thus ground from the bead opening tool 70 to the bead opening tool 70' during the rotation of the tire 43, resulting in grinding a rubberized material together with the mold releasing agent.

When the inner surface of the unbalanced portion of the tire 43 is in this manner sufficiently ground by the grinder wheel 17, the electric motor 22 is stopped to bring the grinder wheel 17 to a standstill, and the actuation of the fluid-operated cylinder 18 is stopped to stop the swinging motion of the swing member 15. Simultaneously, the electric motor 28 is stopped to bring the lower hand-drum shaped rollers 24 and 24' to standstills, causing the upper hand-drum shaped roller 29 and the tire 43 to be stopped. The fluid-operated cylinder 10 is then actuated to cause the piston rod 11 to be retracted and to cause upward movement of the slide member 9 so that the supporting member 13, the swing member 15 and the grinder wheel 17 are consequently lifted upwardly to take the grinder wheel 17 out of the tire casing 43*b* as best shown in FIG. 8. The fluid-operated cylinder 6 is then actuated to cause the piston rod 7 to be projected backwardly and to move the movable frame structure 3 away from the tire 43 so that the supporting member 13, the swing member 15 and the grinder wheel 17 are moved away from the tire 43. The fluid-operated cylinder 34 on the side plate member 2*b* of the stationary frame structure 2 is then actuated to cause the piston rod 37 to retract and thereby lift the upper hand-drum shaped roller 29 through the swing lever 30. The bead opening tools 70 and 70' are then removed from the bead portions 43*a* of the tire 43 which is then manually or automatically rolled over the guide base member 42 to be conveyed to a following process.

A single and complete cycle of operation to have an unbalanced tire ground by the apparatus embodying the present invention has been described in the above explanation. A number of unbalanced tires will be ground through repetition of such cycles. Also, a number of tires having scars on the inner surface of the tires will be ground in the same manner through repetition of such cycles.

Figure 5:
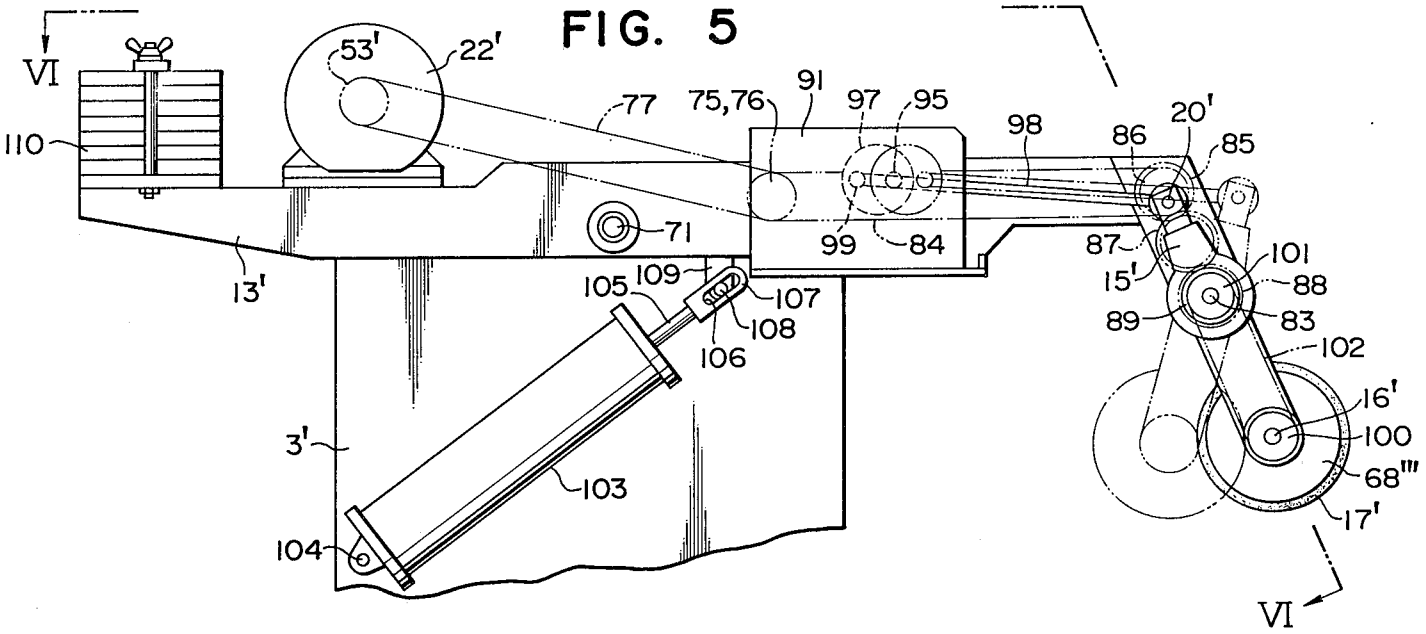
FIG. 5 is a side elevational view showing another preferred embodiment of the apparatus according to the present invention.
Figure 6:
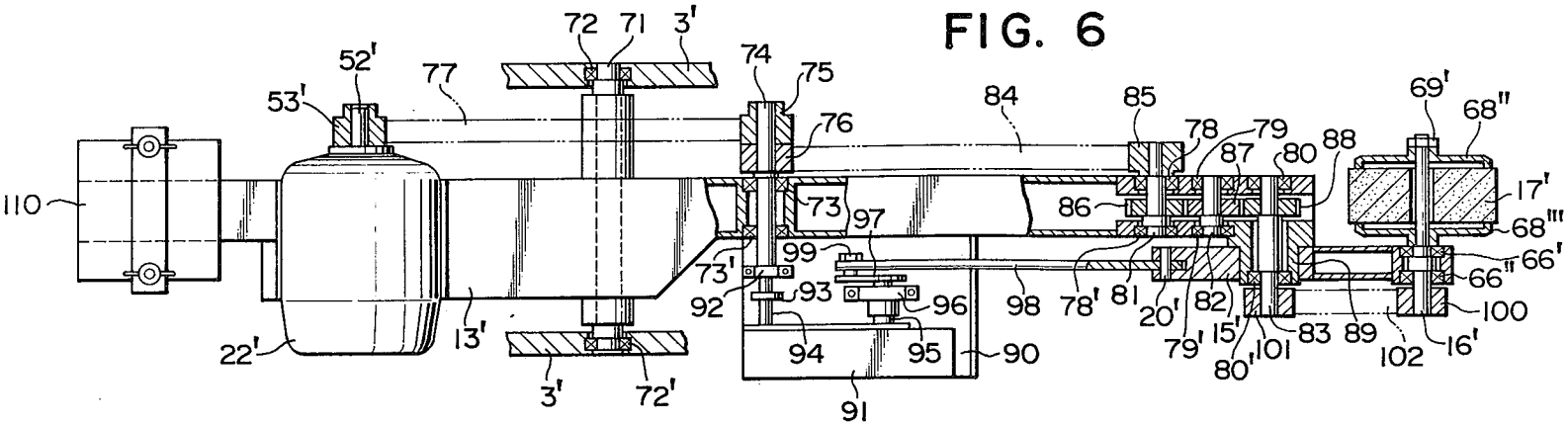
FIG. 6 is a plan view showing the embodiment of the apparatus and partly in section taken along line VI—VI of FIG. 5.

Another embodiment of the present invention will be described hereinafter in detail in FIGS. 5 and 6.

A swingable supporting member 13' is shown to hold at its central portion a pivotal pin 71 which is pivotally mounted by way of bearings 72 and 72' on a movable frame structure 3' corresponding to the movable frame structure 3 in FIGS. 1 and 2. On the supporting member 13' backwardly of the pivotal pin 71 is mounted an electric motor 22', while on the supporting member 13' forwardly of the pivotal pin 71 is rotatably mounted a rotary shaft 74 through bearings 73 and 73' encased in the supporting member 13'. A pulley 53' is fixedly mounted on a rotary shaft 52' of the electric motor 22', and two pulleys 75 and 76 are fixedly mounted on the rotary shaft 74. An endless loop belt 77 is passed on the pulleys 53' and 75 to transmit the torque of the electric motor 22' from the pulley 53' to the pulley 75. Rotary shafts 81, 82 and 83 are rotatably mounted through respective bearings 78, 78', 79, 79', 80 and 80' on the supporting member 13' forwardly of the rotary shaft 74. The endless loop belt 84 passed on the pulley 76 is passed on a pulley 85 fixedly mounted on the rotary shaft 81. Gears 86, 87 and 88 meshed with each other are fixedly mounted on the respective rotary shafts 81, 82 and 83 to transmit the torque of the rotary shaft 81 to the rotary shaft 83. A swing member 15' is rested and rotatably mounted on a projection 89 formed at the forward end portion of the supporting member 13'. A base plate member 90 horizontally extends from the side surface of the supporting member 13' and is adapted to mount a reduction gear unit 91 thereon. A bearing 92 is attached on the base plate member 90 to rotatably support the rotary shaft 74 the forward end of which is connected through a coupling 93 to an input shaft 94 of the reduction gear unit 91. An output shaft 95 of the reduction gear unit 91 is rotatably supported by a bearing 96 mounted on the base plate member 90 and has a free end fixedly mounting an eccentric circular plate 97. A connecting rod 98 has one end pivotally connected through a pivotal pin 20' to the upper end portion of the swing member 15' and the other remaining end pivotally connected through a pivotal pin 99 fixedly secured to the periphery of the eccentric circular plate 97 so that the rotary motion of the eccentric circular plate 97 may be changed to a reciprocal swing motion of the swing member 15'. A rotary shaft 16' is rotatably supported on bearings 66' and 66'' encased in the lower end portion of the swing member 15'. On one free end portion of the rotary shafts 16' and 83 are rigidly mounted pulleys 100 and 101, respectively, over which an endless loop belt 102 is stretched to transmit the torque of the rotary shaft 83 to the rotary shaft 16'. On the free end portion of the rotary shaft 16' opposite to the pulley 100 is supported a grinder wheel 17 which is clamped by a pair of annular clamping metals 68'' and 68''' on the rotary shaft 16' in cooperation with a screw nut 69' threaded onto the rotary shaft 16'. A fluid-operated cylinder 103 is positioned below the supporting member 13' and supported by the movable frame structure 3' through a pivotal pin 104. The fluid-operated cylinder 103 has a piston rod 105 which is connected at its top end to a guide member 107. The guide member 107 has a slot 106 through which a pin 108 fixed to a bracket 109 is projected. The bracket 109 is secured to and extends downwardly from the lower surface of the supporting member 13' at a position forwardly of the pivotal pin 71. When the fluid-operated cylinder 103 is actuated so that the piston rod 105 thereof is caused to axially project and retract, the supporting member 13' is then driven to turn counter-clockwise or clockwise of the drawing about the pivotal pin 71 on the movable frame structure 3'. A counter-balance weight 110 is mounted on the backward portion of the swing member 13' to appropriately adjust the pressure of the grinder wheel 17' against the inner surface of the tire 43.

In this embodiment, the swinging motion of the supporting member 13' is thus performed by the fluid-operated cylinder 103 and the rotary motion of the grinder wheel 17' is carried out by the electric motor 22' through the rotary shaft 52' of the electric motor 22', the pulley 53' on the rotary shaft 52', the endless loop belt 77 passed on the pulleys 53' and 75, the pulley 76 on the rotary shaft 74, the endless loop belt 84 passed on the pulleys 76 and 85, the rotary shaft 81, the gears 86, 87, 88, the rotary shaft 83 on the forward end portion of the supporting member 13', the pulley 101 on the rotary shaft 83, the endless loop belt 102 passed on the pulleys 101 and 100, and the rotary shaft 16' on the lower end portion of the swing member 15'. In this instance, the swinging motion of the swing member 15' is performed by the above electric motor 22' through the rotary shaft 74, the input shaft 94 of the reduction gear unit 91 on the base plate member 90, the reduction gear unit 91, the output shaft 95 of the reduction gear unit 91, the eccentric circular plate 97, the pivotal pin 99 on the eccentric circular plate 97, the connecting rod 98 and the pivotal pin 20' on the upper end portion of the swing member 15'. In this embodiment, the movable frame structure 3' is caused to be frontwardly and backwardly by the fluid-operated cylinder 6 as shown in FIG. 1 in the same manner as mentioned in the above embodiment.

Where desired, a pair of limit switches may be provided on the movable frame structure 3 and actuated by a projection formed on the sliding member 9 or the supporting member 13 to detect the vertical position of the sliding member 9 or the supporting member 13 in the above first embodiment of the present invention as shown in FIGS. 1 and 2. Where also desired, a pair of limit switches may be provided on the movable frame structure 3' to be actuated by a projection formed on the supporting member 13' so that the swung position of the supporting member 13' is detected by the limit switches in the above second embodiment of the present invention as shown in FIGS. 5 and 6.

Where desired, a pair of limit switches may be provided on the swing member 15 to detect both remotest circumferential ends to be ground by the grinder wheel 17 in the above first embodiment of the present invention as shown in FIGS. 1 and 2 in a following manner. When one of the limit switches is brought into contact with the bead opening tool 70 on the bead portions **43*a* of the tire 43 and actuated, the electric motors 22 and 28 are rotated and the fluid-operated cylinder 18 is actuated to commence the guiding operation by the grinder wheel 17. When the other limit switch is then brought into contact with the bead opening tool 70' on the bead portions 43*a* of the tire 43, the electric motors 22 and 28 and the fluid-operated cylinder 18 are stopped to complete the grinding operation by the grinding wheel 17. In this instance, the electric motor 28 may be reversibly be rotated to rotate the tire 43 so that the bead opening tool 70 is again moved toward the grinder wheel 17. If also desired, a pair of limit switches may be provided on the swing member 15' to detect both remotest circumferential ends to be ground by the grinder wheel 17' in the above second embodiment of the present invention as shown in FIGS. 5 and 6** in the same manner as just described above.

When the gap between the bead portions **43*a* of the tire 43 is so wide that the grinder wheel 17 or 17' can easily be passed therethrough, a pair of responsive tapes may be provided on one of the bead portions of the tire 43 in stead of the bead opening tools 70 and 70' and a reflectable photoelectric tube may be provided on the swing member 15 or 15' in stead of the limit switches just mentioned above so that the reflectable photoelectric tube is energized upon facing the responsive tapes to rotate or stop the electric motors 22 or 22' and 28, and to actuate or stop the fluid-operated cylinder 18** in the above first or second embodiment of the present invention.

The vertical and horizontal movements of the grinder wheel 17 caused by the fluid-operated cylinders 6 and 10 may simultaneously be performed to bring the grinder wheel 17 into pressing contact with the inner surface of the tire 43 through the gap between the bead portions thereof in the above first embodiment of the present invention as shown in FIGS. 1 and 2. Also, the fluid-operated cylinders 6 and 103 may be concurrently actuated to move the grinder wheel 17' in the second embodiment of the present invention as shown in FIGS. 5 and 6.

It will, therefore, be understood that all the vehicle tires having unbalanced portions and scars are ground in an automated fashion by the grinding apparatus of the present invention, resulting not only in reducing times to enhance its production efficiency but also in eliminating heavy human labour in the grinding operation of the present invention.

Figure 9:
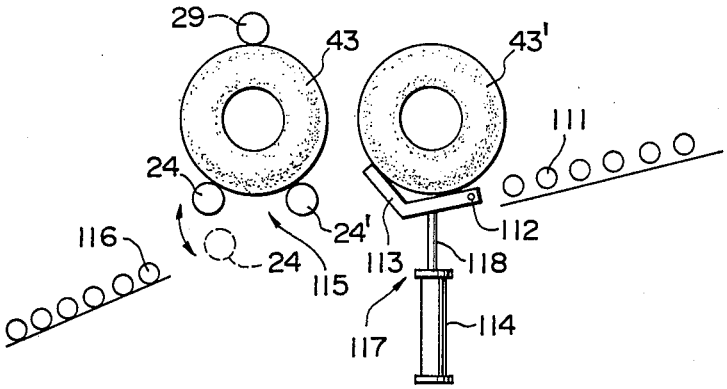
FIG. 9 is a front view showing another preferred embodiment of the apparatus according to the present invention which is provided with a pair of inclined roller conveyors for conveying the tires and a tire receiving unit for temporarily receiving the tires prior to the grinding operation of the embodiment of the present invention.

In order to continuously carry out the grinding operation in a process of manufacturing the vehicle tires, the grinding apparatus of the present invention may preferably comprise a following mechanism shown in FIG. 9.

In FIG. 9, a pair of inclined roller conveyors 111 and 116 are disposed at the both sides of the pair of lower hand-drum shaped rollers 24 and 24' of the apparatus which are roughly and only shown omitting the other parts in FIGS. 1 to 8. The roller conveyors 111 and 116 are spaced from each other at a predetermined distance and positioned in the same inclined plane with each other. The lower hand-drum shaped roller 24 opposite to the roller conveyor 116 is adapted to be rockable about the lower hand-drum shaped roller 24'. Between the lower hand-drum shaped roller 24' and the roller conveyor 111 is provided a tire receiving device 117 which comprises a tire receiving member 113 pivotable about a pin 112 disposed in the vicinity of the inclined roller conveyor 111 and a fluid-operated cylinder 114 having a piston rod 118 pivotally connected at the top end thereof to the intermediate portion of the tire receiving member 113 for pivoting the tire receiving member 113 about the pin 112. When a tire as indicated at 43 is under grinding operation, the fluid-operated cylinder 114 is actuated to cause its piston rod 118 projected so that the tire receiving member 113 is lifted to receive an additional tire 43' for awaiting a subsequent grinding operation. When the grinding operation for the tire 43 is completed, the lower hand-drum shaped roller 24 is moved from a solid line to a dotted line shown in FIG. 9 to transfer the tire 43 to the roller conveyor 116 from the hand-drum shaped rollers 24, 24' and 29. The lower hand-drum shaped roller 24 is then moved back to the solid line from the dotted line, whereupon the upper hand-drum shaped roller 29 is lifted in the same fashion as clearly described above with reference to FIGS. 1 and 2 so as to receive the additional tire 43 on the tire receiving member 113. When the fluid-operated cylinder 114 is then actuated to cause the piston rod 118 retracted, the tire receiving member 113 is caused to lower so that the tire 43' on the tire receiving member 113 is transferred onto the lower hand-drum shaped rollers 24 and 24' for the subsequent grinding operation. The fluid-operated cylinder 114 is then actuated to cause the piston rod 118 projected, the tire receiving member 113 is caused to move upwardly for receiving a subsequent additional tire fed from the roller conveyor 111.

In this embodiment just mentioned above, an appropriate number of limit switches may be provided adjacent the lower hand-drum shaped roller 24 and the tire receiving member 113 to produce signals for controlling the fluid-operated cylinders 6, 10, 18 and 103, the electric motors 22, 22' and 28 so that the actuation of the fluid-operated cylinder 114 and the pivotal movement of the lower hand-drum shaped roller 24 are performed in unison with the movements of the supporting member 13, 13', the swing member 15, 15' and the upper hand-drum shaped roller 29, and the rotation of the grinder wheels 17 and 17'.

It will, therefore, be understood that all the vehicle tires are automatically supplied to and taken out of the hand-drum shaped rollers 24, 24' and 29.

What is claimed is:

1. An apparatus for grinding the inner surface of a vehicle tire to remove rubberized material together with a mold releasing agent comprising:

frame means including a stationary frame structure and a movable frame structure horizontally movably mounted on said stationary frame structure, said movable frame structure having at least a substantially vertically upstanding guide member and a slider slidably coupled with said upstanding guide member;

a supporting member fixedly mounted on the forward surface of said slider;

a swing member pivotally mounted on the forward end portion of said supporting member;

a grinding wheel rotatably mounted on the lower end portion of said swing member;

swinging means mounted on said supporting member for swinging said swing member about its own axis;

grinding wheel rotating means mounted on said slider, said supporting member and said swing member for rotating said grinder wheel;

tire rotating means mounted on said stationary frame structure opposite to said movable frame structure for holding the outer peripheral surface of said vehicle tire and rotating it at a predetermined peripheral speed; and grinding wheel moving means mounted on said frame means for horizontally moving said movable frame structure and vertically moving said slider to move said grinding wheel toward or away from the inner surface of the vehicle tire on said tire rotating means.

2. An apparatus as set forth in claim 1, wherein said grinding wheel moving means includes horizontally actuating means mounted on said stationary frame structure and coupled with said movable frame structure for horizontally moving said movable frame structure and vertically actuating means mounted on said movable frame structure and coupled with said slider for vertically moving said slider so that said grinding wheel moves toward or away from the inner surface of the vehicle tire on said tire rotating means.

3. An apparatus as set forth in claim 2, wherein said horizontally actuating means comprises a fluid-operated cylinder horizontally fixed on said stationary frame structure and having a piston rod connected to said movable frame structure for horizontally moving said movable frame structure, said vertically actuating means comprising a fluid-operated cylinder vertically mounted on said movable frame structure and having a piston rod connected to said slider for vertically sliding said slider along said upstanding guide member so that said grinding wheel moves toward or away from the inner surface of the vehicle tire on said tire rotating means.

4. An apparatus as set forth in claim 1, wherein said swinging means comprises a fluid-operated cylinder having a piston rod pivotally connected to the upper portion of said swing member for swinging said swing member about its own axis, and a rear end portion pivotally connected to a projection formed on said supporting member.

5. An apparatus as set forth in claim 1, wherein said grinding wheel rotating means includes a driving motor on a base plate mounted on said slider, a first rotary shaft rotatably mounted on said supporting member and said swing member at the pivotal axis of said swing member, first intermediate driving means provided between said driving motor and said first rotary shaft for transmitting the torque from said driving motor to said first rotary shaft, a second rotary shaft rotatably mounted on the lower end portion of said swing member supporting said grinding wheel and second intermediate driving means provided between said first rotary shaft and said second rotary shaft for transmitting the torque from said first rotary shaft and said second rotary shaft.

6. An apparatus as set forth in claim 1, wherein said tire rotating means includes a pair of first hand-drum shaped rollers rotatably mounted on said stationary frame structure opposite to said movable frame structure and spaced from each other, each roller having a rotary shaft disposed in parallel with said supporting member, a second hand-drum shaped roller having an axis parallel with said first hand-drum shaped rollers, mounted on said stationary frame structure to be disposed between and above said first hand-drum shaped rollers and movable toward or away from said first hand-drum shaped rollers for holding the outer peripheral surface of said vehicle tire in cooperation with said first hand-drum shaped rollers, a driving motor connected to one of said rotary shaft and intermediate driving means drivably connecting said rotary shafts for transmitting the torque from said one of the rotary shaft to the remaining rotary shaft so that said vehicle tire is held at the outer peripheral surface thereof by said first and second hand-drum shaped rollers and rotated by said first hand-drum shaped rollers.

7. An apparatus as set forth in claim 6, wherein said tire rotating means further includes a swing lever having one end portion rotatably mounting said second hand-drum shaped roller, an intermediate portion pivotally mounted on said stationary frame structure and the remaining end portion pivotally connected to actuating means for swinging said swing lever about said intermediate portion to move said second hand-drum shaped roller toward or away from said first hand-drum shaped rollers.

8. An apparatus as set forth in claim 7, wherein said actuating means comprises a fluid-operated cylinder having a piston rod pivotally connected to the remaining end portion of said swing lever and pivotally held by said stationary frame structure.

9. An apparatus as set forth in claim 1, comprising further inclined upper and lower roller conveyors spaced from each other at a predetermined distance and having the same inclined plane, said roller conveyors being disposed at both sides of said frame structure, said tire rotating means being so adjustable as to be inclined at an angle substantially equal to that of said roller conveyors.

10. An apparatus as set forth in claim 9, comprising further tire receiving means between said inclined upper roller conveyor and said tire rotating means for receiving said vehicle tire to be fed to said tire rotating means for a subsequent grinding operation.

11. An apparatus as set forth in claim 9, wherein said tire receiving means includes a tire receiving member provided pivotally about a pin opposite to said inclined upper roller conveyor, and a fluid-operated cylinder having a piston rod pivotally connected at the top end thereof to the intermediate portion of said tire receiving member for pivoting said tire receiving member about said pin.

12. An apparatus for grinding the inner surface of a vehicle tire to remove rubberized material together with a mold releasing agent comprising:

frame means including a stationary frame structure and a movable frame structure horizontally movably mounted on said stationary frame structure;

a supporting member having an intermediate portion pivotally mounted on said movable frame structure by way of pivotal pin;

a swing member pivotally mounted on the forward end portion of said supporting member;

a grinding wheel rotatably mounted on the lower end portion of said swing member;

swinging means mounted on said supporting member for swinging said swing member about its own axis;

grinding wheel rotating means mounted on said supporting member and said swing member for rotating said grinding wheel;

tire rotating means mounted on said stationary frame structure opposite to said movable frame structure for holding the outer peripheral surface of said vehicle tire and rotating it at a predetermined peripheral speed; and grinding wheel moving means mounted on said frame means for horizontally moving said movable frame structure and pivoting said supporting member to move said grinding wheel toward or away from the inner surface of said vehicle tire on said tire rotating means.

13. An apparatus as set forth in claim 12, wherein said grinding wheel moving means includes horizontally actuating means mounted on said stationary frame structure and coupled with said movable frame structure for horizontally moving said movable frame structure, and swingably actuating means mounted on said movable frame structure for swinging said supporting member about said pivotal pin to move said grinding wheel toward or away from the inner surface of said vehicle tire.

14. An apparatus as set forth in claim 13, wherein said horizontally actuating means consists of a fluid-operated cylinder fixed on said stationary frame structure and having a piston rod connected to said movable frame structure for horizontally moving said movable frame structure, said swingably actuating means comprising a fluid-operated cylinder having a piston rod pivotally connected to said supporting member forwardly of said pivotal pin and having a rear end portion pivotally mounted on said movable frame structure.

15. An apparatus as set forth in claim 12, wherein said grinding wheel rotating means includes a driving motor mounted on said supporting member, a first intermediate rotary shaft rotatably mounted on said supporting member, first intermediate driving means provided between said driving motor and said first intermediate rotary shaft for transmitting the torque from said driving motor to said first intermediate rotary shaft, a second intermediate rotary shaft rotatably mounted on the forward end portion of said supporting member at the pivotal axis of said swing member, second intermediate driving means provided between said first intermediate rotary shaft and said second intermediate rotary shaft for transmitting the torque from said first intermediate rotary shaft to said second intermediate rotary shaft, a grinding wheel rotary shaft rotatably mounted on the lower end portion of said swing member for supporting said grinding wheel, third intermediate driving means provided between said second intermediate rotary shaft and said grinding wheel rotary shaft for transmitting the torque from said second intermediate rotary shaft to said grinding wheel rotary shaft, said swinging means including a reduction gear unit mounted on said supporting member and having an input shaft connected to said first intermediate rotary shaft and an output shaft eccentrically connected to an eccentric circular plate, and a connecting rod having one end pivotally connected to said eccentric circular plate and the other end pivotally connected to the upper end portion of said swing member so that said swing member is caused to be swung through said reduction gear unit and said connecting rod by said first intermediate rotary shaft which simultaneously rotates said grinding wheel through said second intermediate driving means, said second intermediate rotary shaft, said third intermediate driving means and said grinding wheel rotary shaft.

16. An apparatus as set forth in claim 15, comprising further a counter-balance weight mounted on said supporting member backwardly of said pivotal pin, said driving motor being mounted on said supporting member between said counter-balance weight and said pivotal pin.

* * * * *